US006041771A

United States Patent [19]

Hayes

[11] Patent Number: 6,041,771

[45] Date of Patent: Mar. 28, 2000

[54] APPARATUS AND METHOD OF AUTOMATICALLY REGULATING INTAKE OF AIR INTO HEATING UNIT

[76] Inventor: Cecil Joseph Hayes, RR #1 McKinney Rd, Oliver, Canada, V0H-1T0

[21] Appl. No.: 09/157,527

[22] Filed: Sep. 21, 1998

[51] Int. Cl.[7] ..... F24C 1/14

[52] U.S. Cl. ..... 126/77; 126/112; 126/101; 126/290; 110/214; 137/504; 137/517

[58] Field of Search ..... 126/77, 75.15 R, 126/289, 290, 285 R, 288, 112, 60.61, 68, 101; 110/203, 204, 205, 214, 210; 137/504, 517

[56] References Cited

U.S. PATENT DOCUMENTS

| | | | |
|---|---|---|---|
| 70,979 | 11/1867 | Eaton . | |
| 1,194,011 | 8/1916 | Greey et al. . | |
| 1,221,008 | 3/1917 | Thompson . | |
| 1,449,133 | 3/1923 | Street . | |
| 2,151,512 | 3/1939 | Hagen . | |
| 4,180,051 | 12/1979 | Maier et al. . | |
| 4,319,556 | 3/1982 | Schwartz | 127/77 |
| 4,406,396 | 9/1983 | Habegger . | |
| 4,457,294 | 7/1984 | Cumpston | 126/77 |
| 4,483,312 | 11/1984 | Martenson | 126/77 |
| 5,413,088 | 5/1995 | Oviatt . | |

*Primary Examiner*—James C. Yeung
*Attorney, Agent, or Firm*—Oyen Wiggs Green & Mutala

[57] ABSTRACT

This invention relates to a novel apparatus and method for automatically and dynamically regulating the intake of air into the combustion chamber of a heating unit such as a wood burning stove, furnace, or fireplace to ensure even and efficient burning of fuel. More particularly, this invention pertains to a method and apparatus that uses negative gas pressure in the heating unit's flue, and no additional temperature or pressure sensors, to automatically and dynamically control a damper regulating intake of air into the combustion chamber in inverse relation to changes in negative flue gas pressure. This method and apparatus are especially useful in combination with a heating unit having two combustion chambers, one chamber for combustion of solid fuel and a second chamber for further combustion of exhaust gases and other byproducts from combustion in the first chamber. The two-stage combustion in a dual chamber heating unit is an especially dynamic situation where traditional static controls are not very effective.

16 Claims, 3 Drawing Sheets

APPARATUS AND METHOD OF AUTOMATICALLY REGULATING INTAKE OF AIR INTO HEATING UNIT

FIELD OF THE INVENTION

This invention relates to a novel apparatus and method for automatically and dynamically regulating the intake of air into the combustion chamber of a heating unit such as a wood burning stove, furnace, or fireplace to ensure even and efficient burning of fuel. More particularly, this invention pertains to a method and apparatus that uses negative gas pressure in the heating unit's flue, and no additional temperature or pressure sensors, to automatically and dynamically control a single damper regulating intake of air into the combustion chamber in inverse relation to changes in negative flue gas pressure. This method and apparatus are especially useful in combination with a heating unit having two combustion chambers, one chamber for combustion of solid fuel and a second chamber for further combustion of exhaust gases and other byproducts from combustion in the first chamber. The two-stage combustion in a dual chamber heating unit is an especially dynamic situation where traditional static controls are not very effective.

BACKGROUND OF THE INVENTION

The use of dampers to regulate air flow to or from the combustion chamber of a heating unit is known in the art. However, such dampers are typically manually operated, or are part of needlessly complex systems which require separate temperature or pressure sensors or require multiple dampers, or otherwise do not instantly cause each and every change in the amount of negative flue gas pressure to result in an inverse reaction from the damper to regulate the intake of air. The prior art dampers do not establish or exploit a dynamic relationship between negative gas pressure in the flue and a resistive element in the damper in order to automatically and instantly control the amount of intake air entering the combustion chamber.

U.S. Pat. No. 1,449,133 issued Mar. 20, 1923 ("Street") discloses a single damper which controls air flow to both the flue and the combustion chamber. However, the damper is manually operated.

U.S. Pat. No. 5,413,088 issued May 9, 1995 ("Oviatt") discloses a wood burning heat unit. Oviatt discloses drawing outside air through a pipe into a T-connection with branch pipes connected to the chimney and the combustion chamber respectively. The purpose of the pipe connection to the chimney is to divert to the chimney excess intake air that would otherwise enter the combustion chamber, so as to prevent overheating. Multiple dampers in the form of a pair of air pressure actuated flapper valves (78, 80) regulate air flow to each branch pipe respectively. The damper (80) into the combustion chamber is adjusted so that even a small intake air flow will hold it wide open. The damper (78) to the chimney flue is adjusted to a predetermined heavier setting such that a stronger chimney draft is required to open it. Oviatt does not disclose a single damper reacting to all changes in negative flue gas pressure, and to automatically and dynamically adjust intake air accordingly. Rather, damper (80) to the combustion chamber is wide open most of the time and is substantially unaffected by changes in the negative flue gas pressure, while damper (78) to the chimney flue reacts only to dramatic changes in the negative gas pressure of outflow exhaust so as to divert only large amounts of excess intake air in those instances. This multiple damper system permits only clumsy regulation of the volume of intake air. Further, neither damper (78) nor (80) can be manually adjusted to vary their operating range from time to time.

U.S. Pat. No. 1,221,008 issued Mar. 27, 1917 ("Thompson") discloses an invention for an automatic draft control in respect of a boiler. Thompson discloses a system which uses one damper to regulate the intake of air into a combustion chamber and another damper to regulate the chimney exhaust from the combustion chamber, each damper mechanically linked to an apparatus whose position is dependent on the pressure or temperature in the boiler such that the amount of air entering or leaving the combustion chamber is automatically adjusted in accordance with changes in the pressure or temperature in the boiler. However, Thompson does not disclose a means to establish or exploit any form of dynamic relationship between negative gas pressure in the flue and the intake of air into the combustion chamber, let alone specifically an inverse relationship between the two. Rather, Thompson discloses a system where the flue pressure and the air intake are both increased or are both decreased in accordance with a complex mechanism whose position is dependent on the temperature or pressure in a boiler.

U.S. Pat. No. 1,194,011 issued Aug. 8, 1916 ("Greey et al.") also discloses a damper system with separate dampers on the chimney linked to the intake damper by a chain or a cable run through a system of guide pulleys. Greey et al. disclose using a "thermostatic or other motor" to control the dampers using the chain/cable, and in no way disclose using negative flue pressure to automatically operate the air intake damper.

U.S. Pat. No. 4,406,396 issued Sep. 27, 1983 ("Habegger") and U.S. Pat. No. 2,151,512 issued Mar. 21, 1939 ("Hagen") both disclose temperature-regulated combustion air/gas flow methods and apparatus. Habegger discloses using a temperature sensor positioned at the vent between the combustion chamber and the flue in order to control a damper further downstream in the flue so as to regulate the flow of gases through the flue. Habegger does not relates to regulating the intake of air into the combustion chamber.

Hagen is directed toward furnaces used for heating a liquid. Hagen discloses using a thermostatic device to control the intake air damper according to the liquid temperature. Separate thermostatically controlled dampers regulate the chimney outflow.

U.S. Pat. No. 70,979 issued Nov. 19, 1867 ("Eaton") discloses an apparatus which uses the expansion of the stove (B) and the chimney (D) to operate a linkage which controls the air flow through a register (C) and an intake tube (F). When the fire in the stove is being started all the air enters through the register. As the stove and the chimney heat up, they expand and the rod (L) operates on linkage to close the register (C) and open the damper (G) so that intake air is drawn from the upper part of the room, thereby helping to circulate the air in the room.

U.S. Pat. No. 4,180,051 issued Dec. 25, 1979 ("Maier et al.") discloses using a bimetallic thermostat (45) mounted at the front of a furnace to sense the radiant energy from the combustion chamber and to adjust an intake air damper (42) accordingly. However, Maier et al. do not disclose a method or apparatus by which intake air is instantly adjusted in response to changes in negative flue gas pressure.

SUMMARY OF INVENTION

The invention is directed to an apparatus which automatically and dynamically regulates the intake of air into the combustion chamber of a heating unit, in inverse relation to changes in negative gas pressure in the flue, using a single damper and no separate temperature or pressure sensors. The single damper balances the negative flue gas pressure against a resistive element in the damper in order to automatically and dynamically react to each change in negative flue gas pressure and instantly and inversely adjust the amount of intake air accordingly. Typical temperature and pressure sensors such as bimetal thermostatic devices take too long to react, and do not provide the instant, dynamic reaction of the present invention.

In a preferred embodiment, the damper comprises a hollow, vertically-oriented cylindrical can, which has in its interior a coaxial inner can which rotates in accordance with increases in negative flue gas pressure, balanced against an resistive element opposing rotation, preferably in the form of suspension chains or springs. The rotation of the inner can causes changes in the relative sizes of apertures in the inner can, a first aperture allowing intake air to pass into the inner can from an outside air inlet and a second aperture allowing air to pass from the inner can out to the combustion chamber, so as to block excess intake air at times when negative flue gas pressure is high. Where the associated heating unit has more than one combustion chamber, an optional third aperture allows air blocked from entering the first combustion chamber to pass from the inner can out to a second combustion chamber of the heating unit.

A heat selecting element can be incorporated directly into this rotary damper by adding a control arm coaxial with the cans, said control arm adjustable so as to increase or decrease the resistive forces opposing the rotation of the inner can so as to set the overall equilibrium position of the inner can at a desired level.

The heating unit used with the damper preferably has two combustion chambers: the first combustion chamber for burning solid fuel and the second combustion chamber for further combustion of exhaust gases and other byproducts of combustion in the first combustion chamber. A dual chamber heating unit would produce cleaner emissions, especially when used in combination with a damper in accordance with the present invention, which automatically and dynamically adjusts intake air into each combustion chamber of the heating unit so as to ensure optimal combustion.

BRIEF DESCRIPTION OF DRAWINGS

In drawings which illustrate specific embodiments of the invention, but which should not be construed as restricting the spirit or scope of the invention in any way.

DETAILED DESCRIPTION OF SPECIFIC EMBODIMENTS OF INVENTION

The present invention improves the performance of heating units by providing a means by which the intake of air into the combustion chamber of a heating unit can be automatically and dynamically adjusted in reaction to each change in negative gas pressure in the heating unit's flue, using a single damper and no additional temperature or pressure sensors. The damper balances negative flue gas pressure against a resistive element in the damper in order to instantly and inversely adjust intake air accordingly. By doing so, the amount of intake air permitted to enter the combustion chamber is automatically and dynamically adjusted to ensure optimal conditions for clean and efficient combustion.

Preferably, the damper is used in combination with a heating unit having two combustion chambers, wherein the first combustion chamber allows for the burning of solid fuel and the second combustion chamber allows for the burning of exhaust gases and other byproducts of combustion from the first combustion chamber. Such a dual chamber heating unit produces cleaner flue gas emissions than single chamber heating units, particularly when the dual chamber heating unit is operated in combination with a damper that can automatically and dynamically react to changes in said combustion chambers so as to optimize conditions for clean and efficient combustion. The damper according to the present invention can improve the effectiveness of a dual chamber heating unit by automatically and dynamically reacting to changes in negative flue gas pressure in two ways: (i) by instantly and inversely adjusting the intake air into the first combustion chamber, and (ii) by instantly diverting to the second combustion chamber some of the intake air blocked from entering the first combustion chamber.

In doing so, the operation of the heating unit is improved in the following ways:

(a) the air flow and the temperature of the heating unit are automatically regulated so as to result in optimal fuel burning for maximum efficiency;

(b) pollutants in the flue gas emissions are reduced;

(c) build-ups of creosote and tars in the chimney flue are reduced;

(d) the fuel is prevented from being overheated, resulting in longer burning times; and (e) over-production of gases caused by overheating is avoided.

Figure 1:
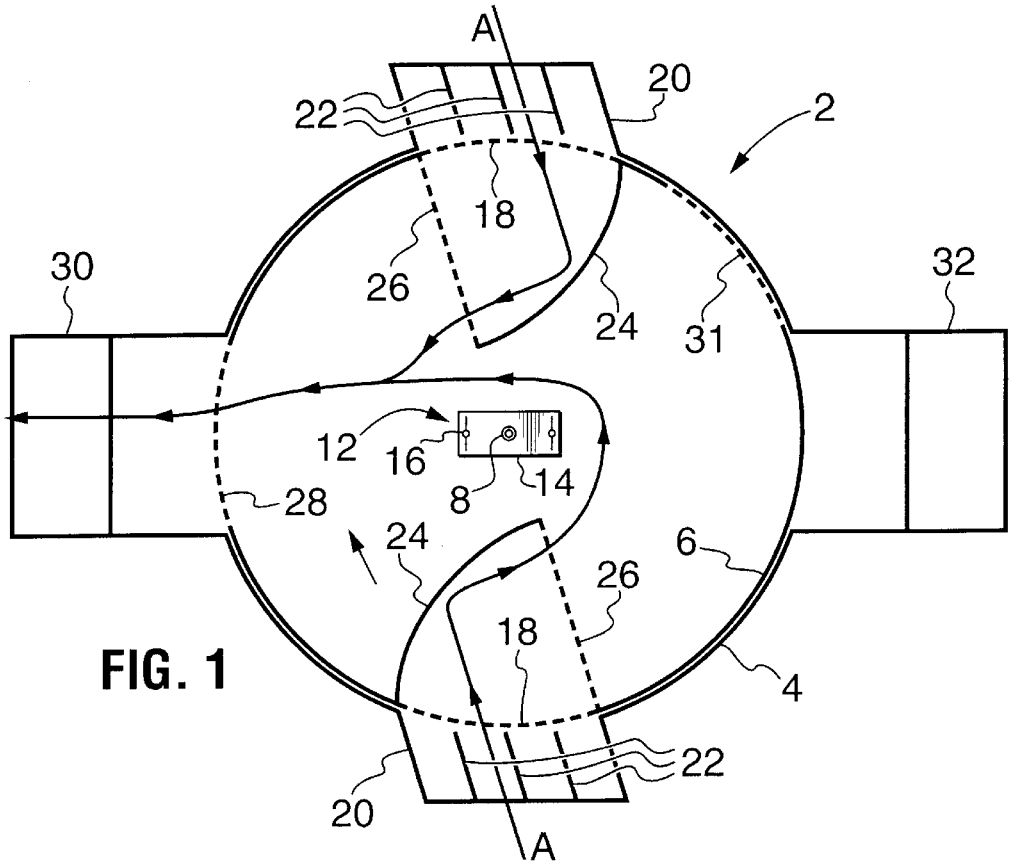
FIG. 1 illustrates a simplified, essentially schematic, horizontal cross section through approximately the center of a preferred embodiment of the damper according to the present invention, as viewed from above said damper.
Figure 2:
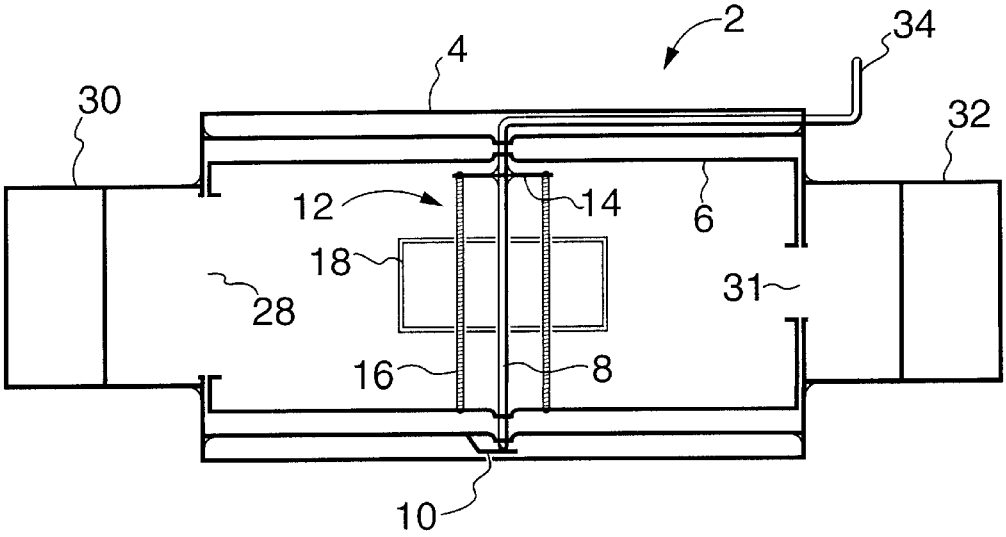
FIG. 2 illustrates a simplified vertical cross section through approximately the center of the damper of FIG. 1, as viewed from the side of said damper.

FIG. 1 illustrates a simplified, essentially schematic, horizontal cross section through approximately the center of a preferred embodiment of a damper 2 according to the present invention, as viewed from above damper 2. FIG. 2 illustrates a simplified vertical cross section through damper 2, as viewed from the side of damper 2. As shown in FIGS. 1 and 2, damper 2 utilizes coaxial cans 4 and 6 wherein inner can 6 is rotatable within outer can 4 about an axis shaft 8, axis shaft 8 being rotatably attached to cans 4 and 6 and supported by support clip 10. A resistive element 12 opposes rotation of inner can 6. Resistive element 12 may comprise a hanger bracket 14 fixedly connected to and perpendicular to axis shaft 8, and elastically connected to inner can 6 by means of one or more suspension chains or springs 16.

Figure 3:
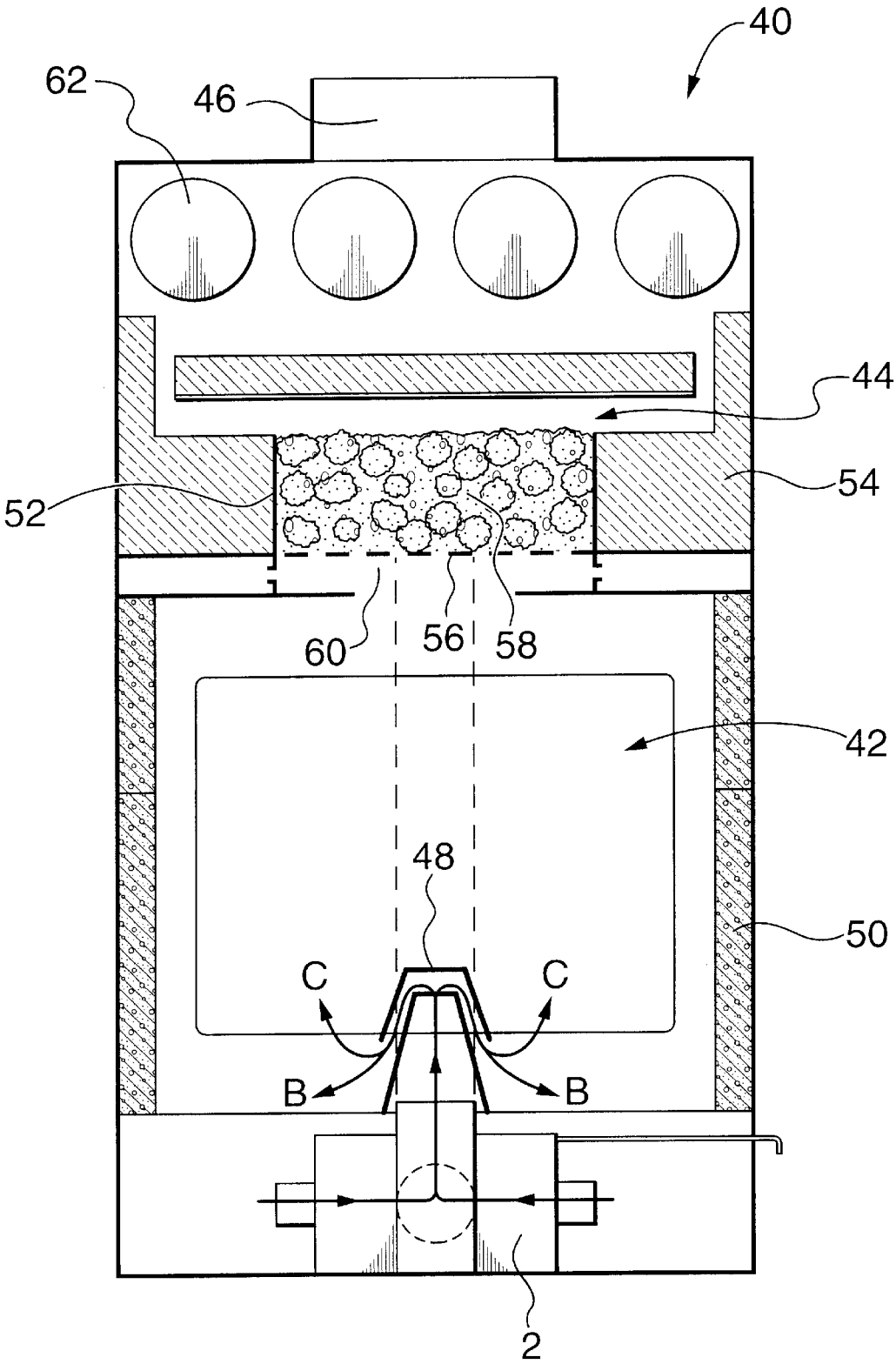
FIG. 3 illustrates a simplified vertical cross section through approximately the center of a dual chamber heating unit with a damper according to the present invention operating therewith, as viewed from the front of said heating unit.
Figure 4:
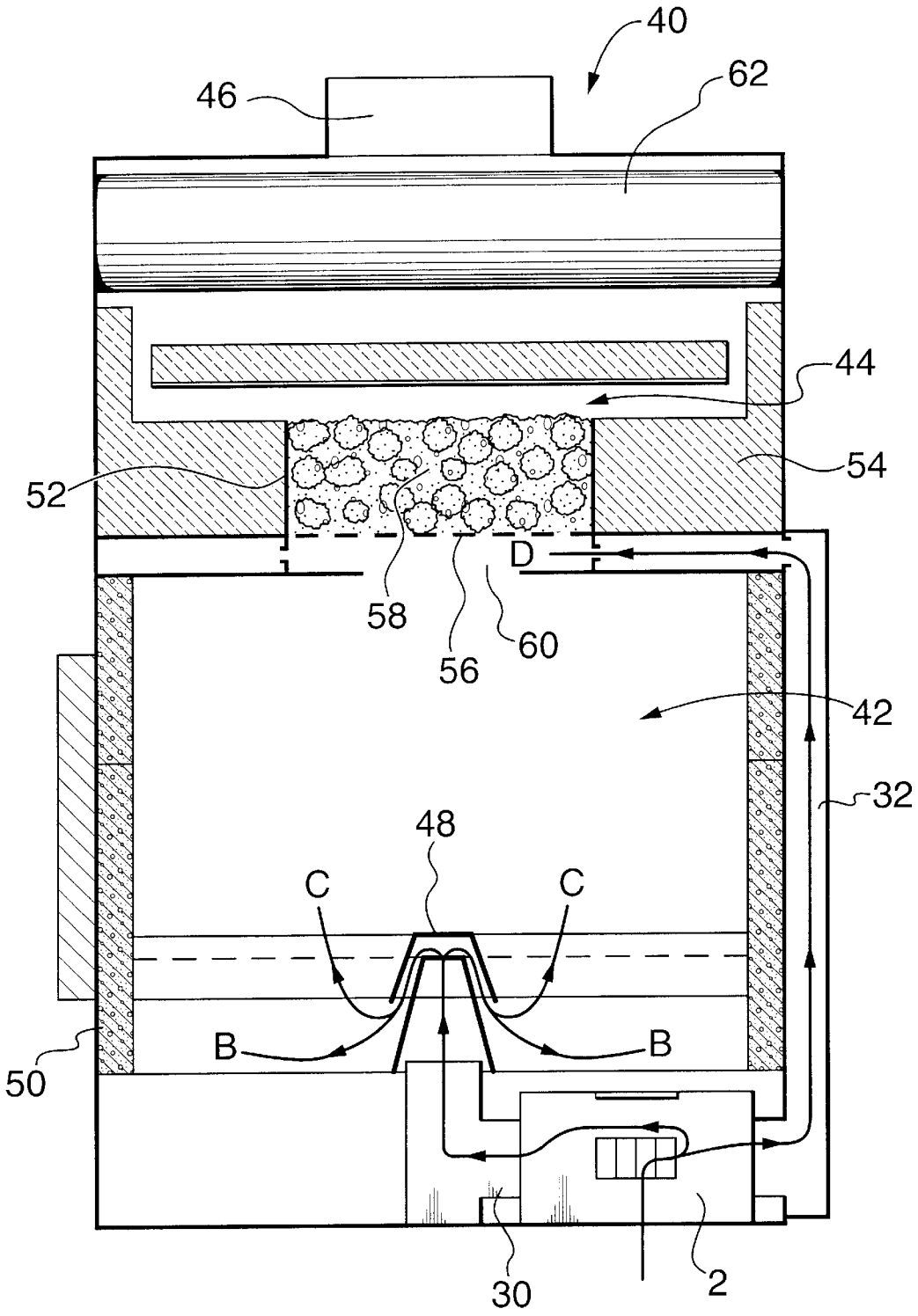
FIG. 4 illustrates a simplified vertical cross section through approximately the center of the heating unit of FIG. 3, as viewed from the side of said heating unit.

FIG. 3 illustrates a simplified vertical cross section through approximately the center of a heating unit 40 with a damper 2 operating therewith, as viewed from the front of heating unit 40. FIG. 4 illustrates a simplified vertical cross section through approximately the center of heating unit 40, as viewed from the side of heating unit 40. Heating unit 40 has a first combustion chamber 42 for combustion of solid fuel. Preferably, heating unit 40 also has a second combustion chamber 44 for combustion of exhaust gases and other byproducts of combustion in first combustion chamber 42. A flue 46 carries away remaining exhaust gases and byproducts, preferably after said gases and byproducts are passed through heat exchange pipes 62.

In starting operation, as shown by flow path A in FIG. 1, intake air enters damper 2 through one or more air intake apertures 18 in inner can 6. Intake air may be directed to each aperture 18 through an air inlet conduit 20 fixedly connected to outer can 4, such intake air preferably further directed in this regard by optional vanes 22 in each air inlet conduit 20. Protruding inwardly from aperture 18 into the interior of inner can 6 is an elbow 24 fixedly attached to inner can 6, such that elbow 24 essentially functions as a continuation of air inlet conduit 20 allowing intake air to pass in a directed manner into the interior of inner can 6. As intake air passes through each aperture 18, it encounters elbow 24 and is then redirected sideways by elbow 24 through an aperture 26 into the interior of inner can 6. From the interior of inner can 6, the intake air passes through aperture 28 into conduit 30 leading into first combustion chamber 42 of a heating unit 40, illustrated in FIGS. 3 and 4.

As shown by flow paths B and C in FIGS. 3 and 4, intake air then passes through a combustion air diffuser 48 before entering first combustion chamber 42, which is a firebox insulated on its sides with a firebrick material 50. Flow path B shows the flow of cold air and flow path C shows the flow of warmer air into first combustion chamber 42, where combustion of solid fuel takes place. Preferably, exhaust gases and other byproducts from combustion in first combustion chamber 42 are subjected to further combustion in a second combustion chamber 44, so that the emissions ultimately passing through flue 46 are even cleaner than would otherwise be the case. At the base of second combustion chamber 44 is a vertical, open-ended, cylindrical pipe 52 separated from the walls of heating unit 40 by an insulating material 54. A horizontal grate 56, the outer edges of which are welded to a ring with the same diameter as cylindrical pipe 52, is fixedly attached to the lower opening of cylindrical pipe 52 so as to form, in combination with cylindrical pipe 52, a receptacle in which volcanic rock 58 or similar material can be placed for the combustion of exhaust gases and other byproducts of combustion from first combustion chamber 42. Said exhaust gases and other byproducts pass from first combustion chamber 42 to second combustion chamber 44 through a duct 60 in the form of a sandwich baffle with a larger aperture in its top than in its bottom. Said exhaust gases and byproducts are further combusted in the volcanic rock 58 of combustion chamber 44 in a clean gas fire, after which remaining emissions flow through flue 46 after passing through optional heat exchanger pipes 62. The cleaner emissions produced by the dual chamber heating unit 40 in accordance with the present invention allow heat exchanger pipes 62 to be used without the problem of said pipes gumming up as would be the case with traditional, single chamber heating units.

A dual chamber heating unit functions well only under favorable conditions. To ensure said favorable conditions, flow of intake air needs to be automatically and dynamically adjusted in response to the dynamic situation in the combustion chambers; static controls are not very effective. Therefore, in accordance with the present invention, damper 2 automatically and dynamically adjusts intake air to ensure such optimal conditions.

In operation, as the combustion rate in heating unit 40 increases, negative gas pressure in flue 46 increases. The increase in negative gas pressure in flue 46 causes suction and a corresponding increase in the amount of intake air trying to pass through damper 2 into first combustion chamber 42 of heating unit 40, but such intake air is automatically regulated by damper 2. The increased volume of intake air on the outer curvature of elbow 24 of damper 2 creates an outward radial force which impinges on the outer curvature of elbow 24 and causes inner can 6 to rotate against resistive element 12. The greater the volume of intake air, the greater the velocity of intake air, hence the greater the outward radial force, and hence the greater the rotation of inner can 6, while, at the same time, the greater the resistance caused by resistive element 12. Also, the greater the rotation of inner can 6, the smaller the relative sizes of apertures 18 and 28 become. In operation, inner can 6 reacts to increases in negative gas pressure in flue 46 by rotating, and automatically and dynamically decreasing the sizes of apertures 18 and 28, therefore blocking a portion of the intake air from entering first combustion chamber 42. Similarly, inner can 6 reacts to decreases in negative gas pressure in flue 46 by reducing rotation, and automatically and dynamically increasing the sizes of apertures 18 and 28, therefore permitting greater volumes of air to pass to first combustion chamber 42. Accordingly, damper 2 automatically and dynamically maintains the volume of intake air permitted to pass to first combustion chamber 42 at a more or less constant volume, and responds instantly to each change in the conditions in heating unit 40 so as to ensure even and optimal combustion.

Where heating unit 40 has a second combustion chamber 44, inner can 6 preferably utilizes an additional aperture 31 capable of diverting excess intake air to second combustion chamber 44 through a conduit 32, in a manner complementary to the tendency of inner can 6 to block excess intake air from entering first combustion chamber 42 as inner can 6 rotates. As negative gas pressure in flue 46 increases and inner can 6 increasingly rotates, the relative size of aperture 28 will decrease and the relative size of aperture 31 will increase, thereby diverting an increasing proportion of the available intake air through conduit 32 to second combustion chamber 44. By doing so, less air will be available for combustion of solid fuel in first combustion chamber 42 and more air will be available for combustion of exhaust gases and byproducts in second combustion chamber 44, such that the conditions that led to the increased negative flue gas pressure in the first place will be moderated and the increased emissions increasingly cleaned. This is illustrated in FIG. 4 by flow path D. As negative gas pressure in flue 46 increases, intake air will increasingly follow flow path D rather than flow paths B and C.

An optional heat selecting element to manually set the operating range of damper 2 to desired thresholds from time to time, can be incorporated into damper 2 by fixedly connecting a control arm 34 to axis shaft 8, control arm 34 rotatable on the axis of cans 4 and 6. By manually rotating control arm 34 counter to the direction in which inner can 6 tends to rotate, resistive element 12 is pre-engaged at a desired level and the resistive force opposing rotation of inner can 6 is increased, thereby requiring a greater degree of negative gas pressure in flue 46 before inner can 6 will rotate than would be the case with no control arm 34. By manually adjusting control arm 34, damper 2 can be manually set to automatically and dynamically block intake air once negative gas pressure in flue 46 surpasses a predetermined threshold corresponding to the degree of resistive force represented by the position of control arm 34. Optionally, control arm 34 can be operably linked to an ambient outside thermostatic device.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus, for use in combination with a heating unit having a combustion chamber and a flue, said apparatus for regulating the intake of air into said combustion chamber, said apparatus comprising a resistive, movable, negative-flue-gas-pressure-sensitive damper movable between a first position and a second position, the first position representing the maximum amount of air permitted to flow from an outside air inlet into said combustion chamber and the second position representing the minimum amount of air permitted to flow from said outside air inlet into said combustion chamber, the position of said damper between said first and second positions being a function of a dynamic relationship between the degree of negative gas pressure in said flue balanced against a resistive element in said damper, such that said damper dynamically regulates intake air entering said combustion chamber, wherein the damper comprises:

(a) a hollow, cylindrical outer can;

(b) a rotative element within said outer can, rotatable about the axis of said outer can and tending to rotate in response to increases in negative gas pressure in said flue; and (c) a resistive element opposing rotation of said rotative element, such that the degree of rotation of said rotative element is determined by balancing the opposing force created by the resistive element against the rotative force created by negative gas pressure in said flue, said damper permitting air to pass from said outside air inlet through said damper to said combustion chamber, the amount of air so entering and leaving the damper having an inverse relation to the degree of rotation of said rotative element.

2. An apparatus as claimed in claim 1 further comprising a heat selecting element operably connected to said rotative element or to said resistive element and capable of adjusting the degree of rotatability of said rotative element within said outer can.

3. An apparatus as claimed in claim 1 wherein said resistive element comprises a hollow, cylindrical inner can coaxial with said outer can, rotatable about its axis, and tending to rotate in response to increases in negative gas pressure in said flue, said damper permitting air to pass from said outside air inlet into the interior of said inner can, and then from the interior of said inner can out to said combustion chamber, the amount of air so entering and leaving the interior of said inner can having an inverse relation to the degree of rotation of said inner can.

4. An apparatus as claimed in claim 3 wherein the resistive element comprises one or more springs or suspension chains.

5. An apparatus as claimed in claim 3 further comprising a heating selecting element operably connected to said inner can or to said resistive element and capable of adjusting the degree of rotatability of said inner can within said outer can.

6. An apparatus as claimed in claim 5 wherein said heat selecting element comprises a control arm operably connected to said resistive element, said control arm adjustable so as to increase or decrease the resistive forces opposing the rotation of said inner can.

7. An apparatus as claimed in claim 1, wherein said heating unit has a first combustion chamber and a second combustion chamber operably connected to said first combustion chamber, and wherein said damper is operably connected to an air inlet into each of said first combustion chamber and second combustion chamber, and wherein said apparatus is configured such that intake air blocked by said damper from entering said first combustion chamber is diverted to said second combustion chamber through a conduit connecting said damper and said air inlet into said second combustion chamber.

8. An apparatus as claimed in claim 7, wherein said second combustion chamber allows for the combustion of exhaust gases and other byproducts of combustion in said first combustion chamber.

9. A heating unit having a combustion chamber and a flue, operably connected to the apparatus claimed in claim 1, resulting in an integrated heating unit system wherein intake air into said combustion chamber is dynamically regulated by said damper as a function of negative gas pressure in said flue.

10. The heating unit claimed in claim 9, having a first combustion chamber and a second combustion chamber operably connected to said first combustion chamber, and wherein said damper is operably connected to an air inlet into each of said first combustion chamber and second combustion chamber, and wherein intake air blocked by said damper from entering said first combustion chamber is diverted to said second combustion chamber through a conduit connecting said damper and said air inlet into said second combustion chamber.

11. The heating unit claimed in claim 10, wherein:

(a) said first combustion chamber allows for the combustion of solid fuel; and (b) said second combustion chamber allows for the combustion of exhaust gases and other byproducts from combustion in said first combustion chamber.

12. The heating unit claimed in claim 9, further comprising heat exchange pipes within said heating unit between said second combustion chamber and said flue.

13. A method of dynamically regulating the intake of air into a combustion chamber of a heating unit having a flue, said method using negative gas pressure in said flue to dynamically operate a damper to control said intake of air, and comprising the following steps:

(a) selecting a damper having (i) a hollow, cylindrical outer can, (ii) a rotative element within said outer can, rotatable about the axis of said outer can and tending to rotate in response to increases in negative gas pressure in said flue, and (iii) a resistive element opposing rotation of said rotative element, such that the degree of rotation of said rotative element is determined by balancing the opposing force created by the resistive element against the rotative force created by negative gas pressure in said flue;

(b) connecting said damper operably to an outside air inlet and to an air inlet into said combustion chamber; and (c) permitting air to pass from said outside air inlet through said damper to said air inlet into said combustion chamber, the amount of air so entering and leaving the damper having an inverse relation to the degree of rotation of said rotative element.

14. The method as claimed in claim 13, including the additional step of installing a heat selecting element to control the operating range of said damper.

15. A method of dynamically regulating the intake of air into combustion chambers of a heating unit having a flue, wherein said heating unit has a first combustion chamber and a second combustion chamber, said method using negative gas pressure in said flue to dynamically operate a damper to control said intake of air and said method comprising the following steps:

(a) selecting a damper having (i) a hollow, cylindrical outer can, (ii) a rotative element within said outer can, rotatable about the axis of said outer can and tending to rotate in response to increases in negative gas pressure in said flue, and (iii) a resistive element opposing rotation of said rotative element, such that the degree of rotation of said rotative element is determined by balancing the opposing force created by the resistive element against the rotative force created by said negative gas pressure in said flue;

(b) connecting said damper operably to an outside air inlet, to an air inlet into said first combustion chamber, and to an air inlet into said second combustion chamber;

(c) permitting air to pass from said outside air inlet through said damper to said air inlet into said first combustion chamber, the amount of air so entering and leaving the damper having an inverse relation to the degree of rotation of said rotative element; and (d) permitting air blocked from entering said first combustion chamber to be diverted to said second combustion chamber.

16. The method as claimed in claim 15, including the additional step of installing a heat selecting element to control the operating range of said damper.

* * * * *